US006637498B1

(12) United States Patent
Macheske et al.

(10) Patent No.: US 6,637,498 B1
(45) Date of Patent: Oct. 28, 2003

(54) MODULARIZED PERMANENT MOLDING MACHINE WITH MULTIPLE MOLDS

(75) Inventors: Robert L. Macheske, Tawas City, MI (US); Alan P. Gould, Tawas City, MI (US); Thomas J. H. Rozich, Au Gres, MI (US); Daniel D. Minor, Cadillac, MI (US); Kenneth D. McKibben, Defiance, OH (US)

(73) Assignee: Hayes Lemmerz International, Northville, MI (US)

( * ) Notice: Subject to any disclaimer, the term of this patent is extended or adjusted under 35 U.S.C. 154(b) by 166 days.

(21) Appl. No.: 10/003,142

(22) Filed: Nov. 15, 2001

(51) Int. Cl.[7] ..... B22D 5/00; B22D 17/26

(52) U.S. Cl. ..... 164/322; 164/323; 164/325; 164/326; 164/342; 164/343; 164/341

(58) Field of Search ..... 164/322, 323, 164/325, 326, 342, 343, 167, 168, 341, 137

(56) References Cited

U.S. PATENT DOCUMENTS 5,647,427 A * 7/1997 Collins et al. ..... 164/459
5,701,945 A * 12/1997 Mckibben et al. ..... 164/130
6,425,435 B1 * 7/2002 Macheske et al. ..... 164/326

* cited by examiner

*Primary Examiner*—M. Alexandra Elve
*Assistant Examiner*—I.-H. Lin
(74) *Attorney, Agent, or Firm*—MacMillan, Sobanski Todd, LLC

(57) ABSTRACT

A permanent mold casting system has a modularized architecture and remote placement of certain portions of the casting system. The casting system has a frame and a casting module supported on the frame is adapted to receive a plurality of molds for casting articles from a fill material according to a casting process. The casting module includes first motive actuators for moving at least portions of the molds during the casting process. An accessories module is supported on the frame and comprises at least one accessory device and second motive actuators for selectably positioning the accessory device in relation to the casting module. A utility module is located remotely from the frame and comprises motive power supplies coupled to the first and second actuators. The utility module also comprises a programmable controller coupled to the motive power supplies for controlling the casting process.

5 Claims, 4 Drawing Sheets

MODULARIZED PERMANENT MOLDING MACHINE WITH MULTIPLE MOLDS

BACKGROUND OF THE INVENTION

The present invention relates to permanent mold casting machines, and more specifically to increasing the productivity of a casting machine using a particular modularization that facilitates the use of multiple molds in one machine.

It is known to use a casting machine having a casting mold to make cast articles. Examples of cast articles include aluminum pistons and wheels, and various plastic pieces used in a wide variety of industries. The casting mold typically has two or more mold sections, such as for example a first mold half and an second hold half. When the first mold half and the second hold half are placed together, they define a cavity. The cavity is in the general shape of the cast articles to be produced. A fill material, such as metal or plastic is inserted (e.g., poured) into the cavity and allowed to cool. The first mold half and the second hold half can then be separated from each other, leaving the cast article.

Various motive devices (such as hydraulic actuators, motor drives, and servo-mechanisms) are used on casting machines for moving mold sections into place and then retracting them, for tilting the machine to improve flow of the fill material, for removing finished articles, and for other purposes. These devices each include a mechanical actuator portion (e.g., a hydraulic cylinder) and a motive power supply portion (e.g., an electrically-controlled valve and fluid supply lines feeding the hydraulic cylinder). For complicated articles using multiple mold sections and complex processing, the number of motive devices can become quite large on a single casting machine and can occupy a significant amount of space.

In order to speed cooling of fill material in a mold and sometimes to control the cooling rate, cooling channels carrying cooling fluid are deployed within and/or around the mold. Control valves mounted on the casting machine turn fluid flow on and off and/or modulate the flow to provide the desired cooling profile.

The casting machine typically includes a programmable controller having operating instructions that govern movement of the mold sections, filling of the cavity with the fill material, tilting of the machine, and the like. The controller is generally relatively expensive and is dedicated for use with a single casting machine. In normal operation, a casting machine is subject to "down time" due to a variety of causes, resulting in a period of non-productivity. This non-productivity results in the dedicated controller also being unused, and represents a waste of the capital invested in the controller. Furthermore, the dedicated controller is typically mounted to the casting machine itself, using up more of the limited space available in a single machine.

Due to the space and packaging requirements of all the various components of a casting machine, the prior art has severe limitations in the number and arrangement of molds that can be supported in a single casting machine. Furthermore, the close spacing and crowded arrangement of components makes maintenance of the components more difficult and costly.

SUMMARY OF THE INVENTION

The present invention has the advantages of reduced cost and improved performance as a result of a modularized architecture and remote placement of certain portions of the casting system.

In on primary aspect, the invention provides a casting system having a frame. A casting module is supported on the frame and is adapted to receive a plurality of molds for casting articles from a fill material according to a casting process. The casting module includes first motive actuators for moving at least portions of the molds during the casting process. An accessories module is supported on the frame and comprises at least one accessory device and second motive actuators for selectably positioning the accessory device in relation to the casting module. A utility module is located remotely from the frame and comprises motive power supplies coupled to the first and second actuators. The utility module also comprises a programmable controller coupled to the motive power supplies for controlling the casting process.

DETAILED DESCRIPTION OF PREFERRED EMBODIMENTS

The components for, and use in, the casting system will generally be discussed in the context of their use for producing a piston. The piston is a non-limiting example of a cast article that may be produced with the invention. It is contemplated that the casting system of the invention is useful in a wide variety of manufacturing applications.

Figure 1:
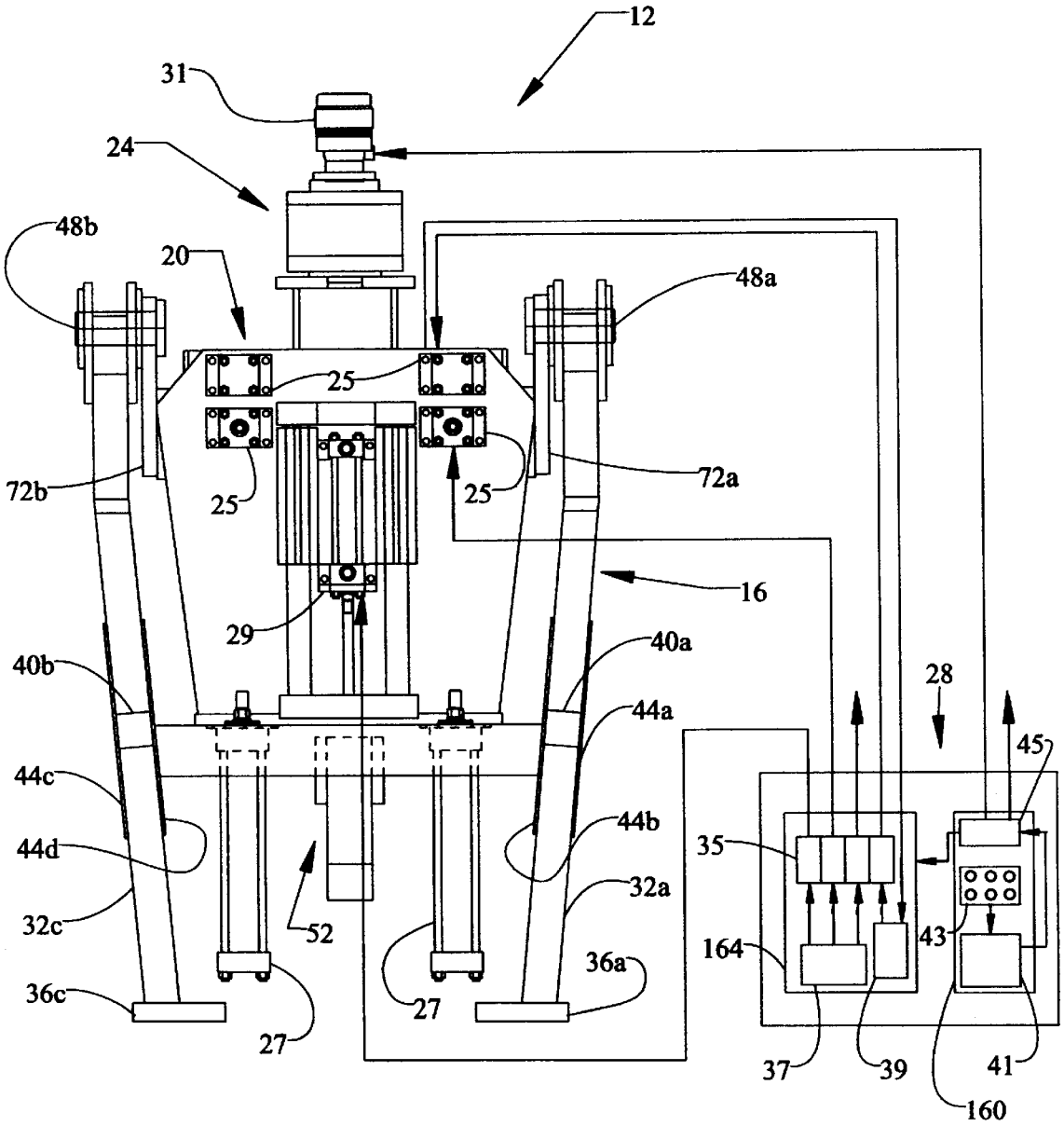
FIG. 1 is an elevational schematic of a casting system according to the invention.
Figure 2:
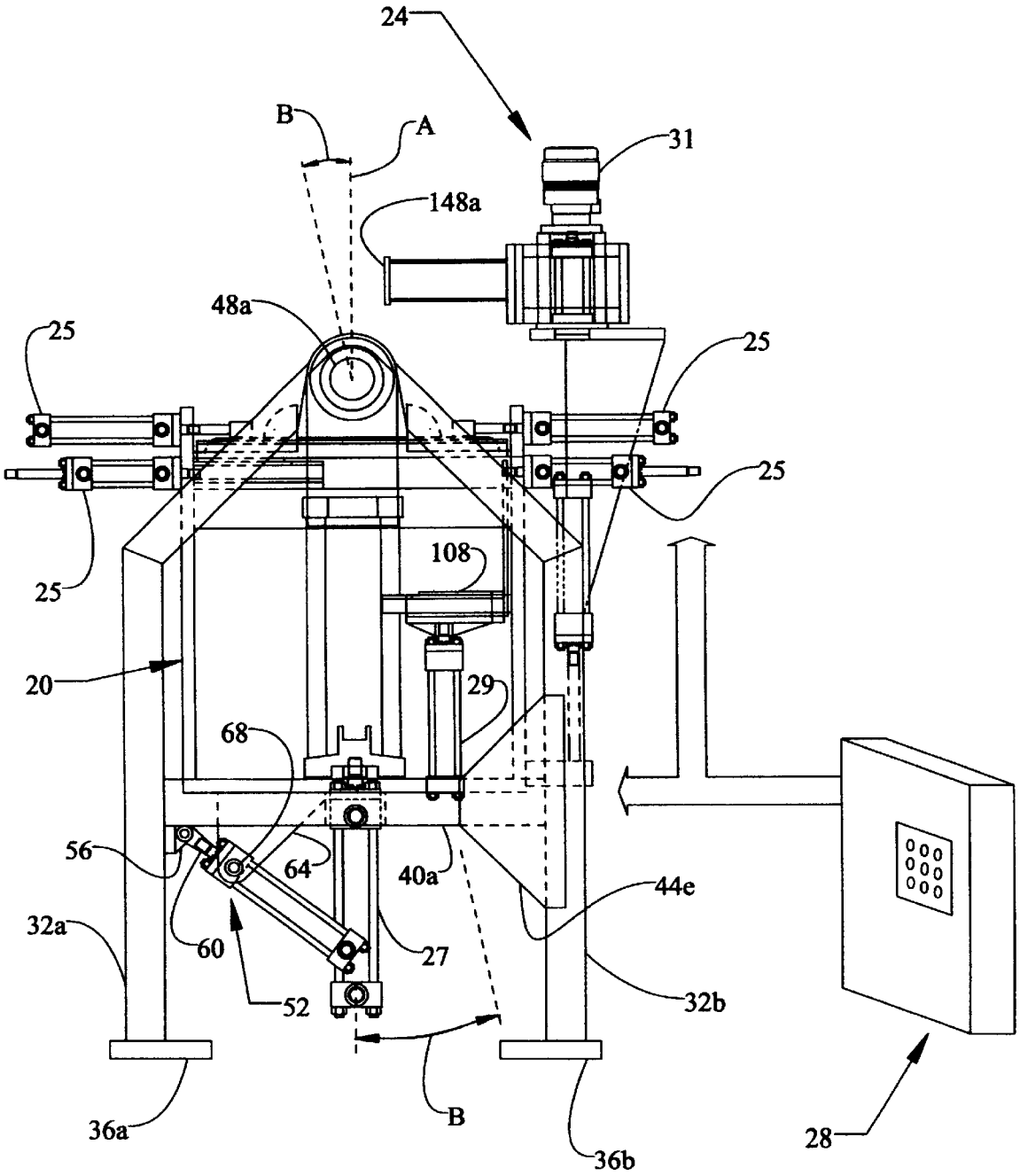
FIG. 2 is an elevational schematic side view of the casting system shown in FIG. 1.
Figure 3:
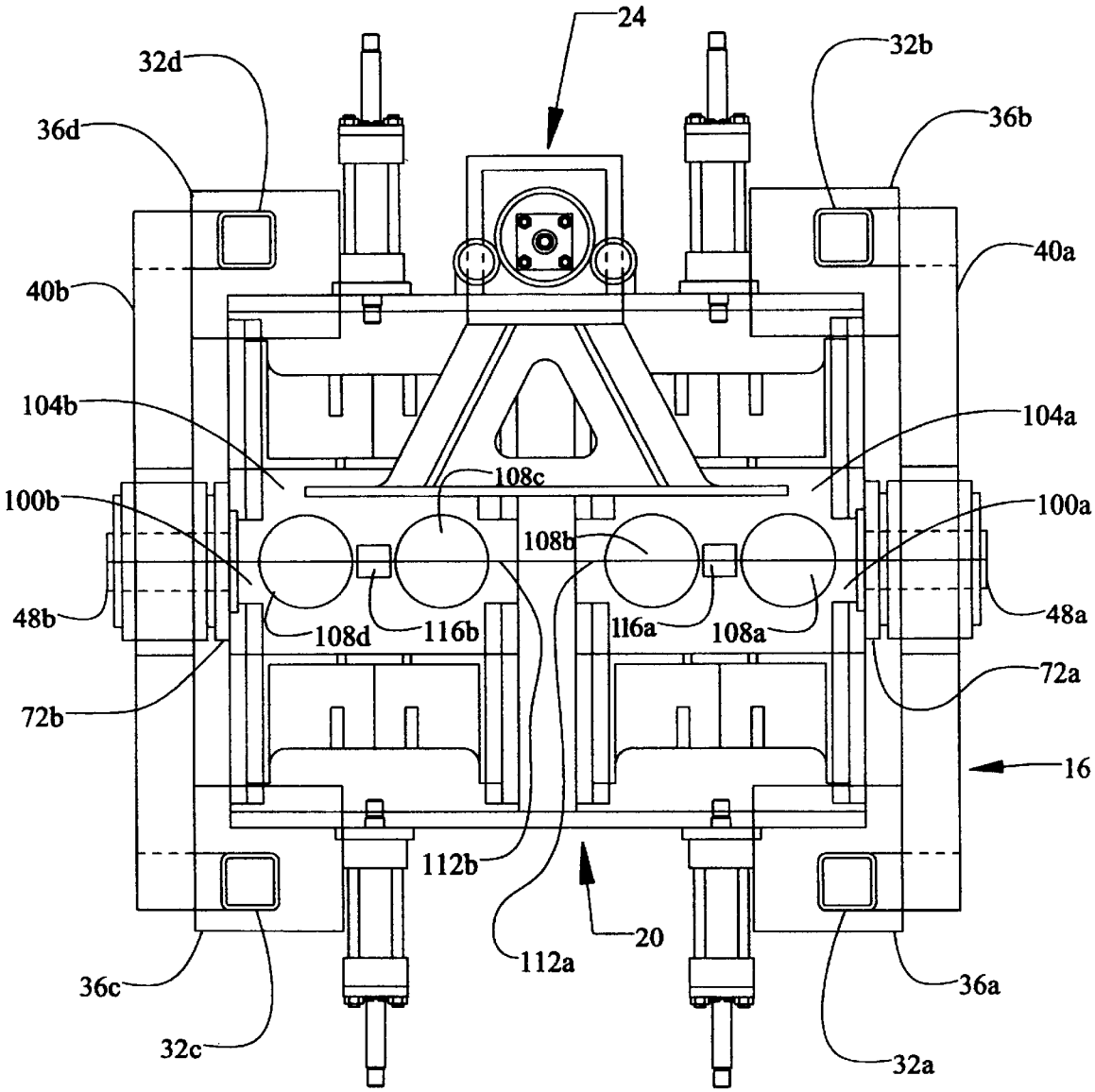
FIG. 3 is a top plan view of the casting system shown in FIG. 1 viewed along line 3—3.

Referring now to FIGS. 1 through 3, there is illustrated a casting system, shown generally at 12, in accordance with the present invention. The casting system 12 preferably includes a support structure module or frame 16, a casting module 20, an accessories module 24, and a utility module 28. For purposes of clarity, only those portions of the casting system 12 necessary for the understanding and description of the invention will be discussed herein.

The support structure module 16 is positioned and provided in the casting system 12 to support and stabilize the casting module 20. The illustrated support structure module 16 includes four legs 32*a–d*. The legs 32*a–d* are generally vertically extending beams having a generally square cross-sectional shape. The illustrated legs 32*a–d* may be bowed slightly outwardly to accommodate the casting module 20 positioned therebetween. The illustrated legs 32*a–d* include lower supports 36*a–d*. The lower supports 36*a–d* are provided to stabilize the support structure module 16. The illustrated support structure module 16 also includes one or more beams 40*a* and 40*b* to connect the leg 32*a* to the leg 32*b* and the leg 32*c* to the leg 32*d*, respectively. A number of plates, including plates 44*a–d* on the front legs, add support and stability. Similar plates are used on the rear legs such as plate 44*e* in FIG. 2 (plate 44*a* is removed from FIG. 2 to show other detail).

The illustrated support structure module 16 also includes two pivots 48*a,b*. For the illustrated casting system 12, the pivots 48*a,b* are positioned near the top of the support structure module 16, although they may be positioned at any suitable location. FIG. 2 shows an axis "A" positioned generally vertically through the pivot 48*a*. The pivots 48*a,b* are positioned to allow the casting module 20 to be positioned at a tilt with respect to the support structure module 16. The casting module 20 is positioned at an angle "B." The angle "B" is a tilt angle, and can range up to about 20° from vertical in either direction, for example. Of course, the machine can be constructed to provide any desired forward or backward tilt as needed for any particular manufacturing application. The casting module 20 can be used to produce cast articles by stationary methods, tilt methods, or both.

The illustrated support structure module 16 also includes a tilt assembly 52, shown in FIG. 2. The support structure module 16 may include more than one tilt assembly 52. The tilt assembly 52 is operative to facilitate positioning of the casting module 20, such as for example when the casting module 20 is positioned at a tilt. The illustrated tilt assembly 52 includes a first plate 56 and a rod 60 and a second plate 64 and a receiver 68. The second plate 64 is operatively connected to the casting module 20. The rod 60 is part of a hydraulic actuator that slideably engages the receiver 68 to selectively change the tilt position of the casting module 20.

The tilt assembly 52 of FIG. 2 is shown in a retracted position, with the casting module 20 being positioned at the angle "B" of about zero. The tilt assembly 52 can also be positioned in an extended position. When the tilt assembly 52 is positioned in the extended position, the position of the first plate 56 and the position of the second plate 64 change with respect to each other. In other words, the tilt assembly 52 operates to increase the space between the first plate 56 and the second plate 64.

The illustrated support structure module 16 also includes two suspension plates 72*a,b*. The plates 72*a,b* are pivotally connected to the pivots 48*a,b* respectively. The plates 72*a,b* are also operatively connected to the casting module 20. The plates 72*a,b* are positioned to allow the tilt position of the casting module 20 to selectively be positioned at the angle "B."

The casting module 20 is positioned and provided in the casting system 12 to produce a cast article. The illustrated casting module 20 includes two first mold halves 100*a,b* and two second mold halves 104*a,b*. The illustrated first mold halves 100*a,b* and the illustrated second mold halves 104*a,b* cooperate to define cavities 108*a–d*. The illustrated casting module 20 includes four cavities 108*a–d*, though any suitable number of cavities may be included. The illustrated cavities 108*a–d* are spaced apart from each other and are generally cylindrical openings. The first mold halves 100*a,b* and the second mold halves 104*a,b* are positioned together to define part lines 112*a,b* between them. In operation, the first mold halves 100*a,b* and the second mold halves 104*a,b* moved toward and apart from each other at the part lines 112*a,b*.

The illustrated casting module 20 includes two fill inlets 116*a,b*. The illustrated fill inlets 116*a,b* are generally square openings. The illustrated fill inlet 116*a* is positioned between, and is in fluid communication with, the cavities 108*a,b*. The illustrated fill inlet 116*b* is positioned between, and is in fluid communication with, the cavities 108*c,d*. In operation, a fill material is placed into the fill inlets 116*a,b*. The fill material may be placed into the fill inlets 116*a,b* in any suitable manner, such as for example by gravity pouring from a ladle. The fill material flows or otherwise moves from the fill inlets 116*a,b* into the cavities 108*a–d*. Positioning the casting module 20 at a tilt may enhance the casting process by improving filling of the cavities 108*a–d* and reducing casting scrap.

In addition to the hydraulic cylinder for tilting, casting module 20 includes other motive actuators for moving various components of the machine, such as the mold sections. For example, horizontal hydraulic actuators 25 are arranged for moving mold sections into and out of registration for casting and then removing cast articles. Vertical hydraulic actuators 27 and 29 move mold sections for registration during mold and/or for inspection and removal of mold sections from the casting machine.

Figure 4:
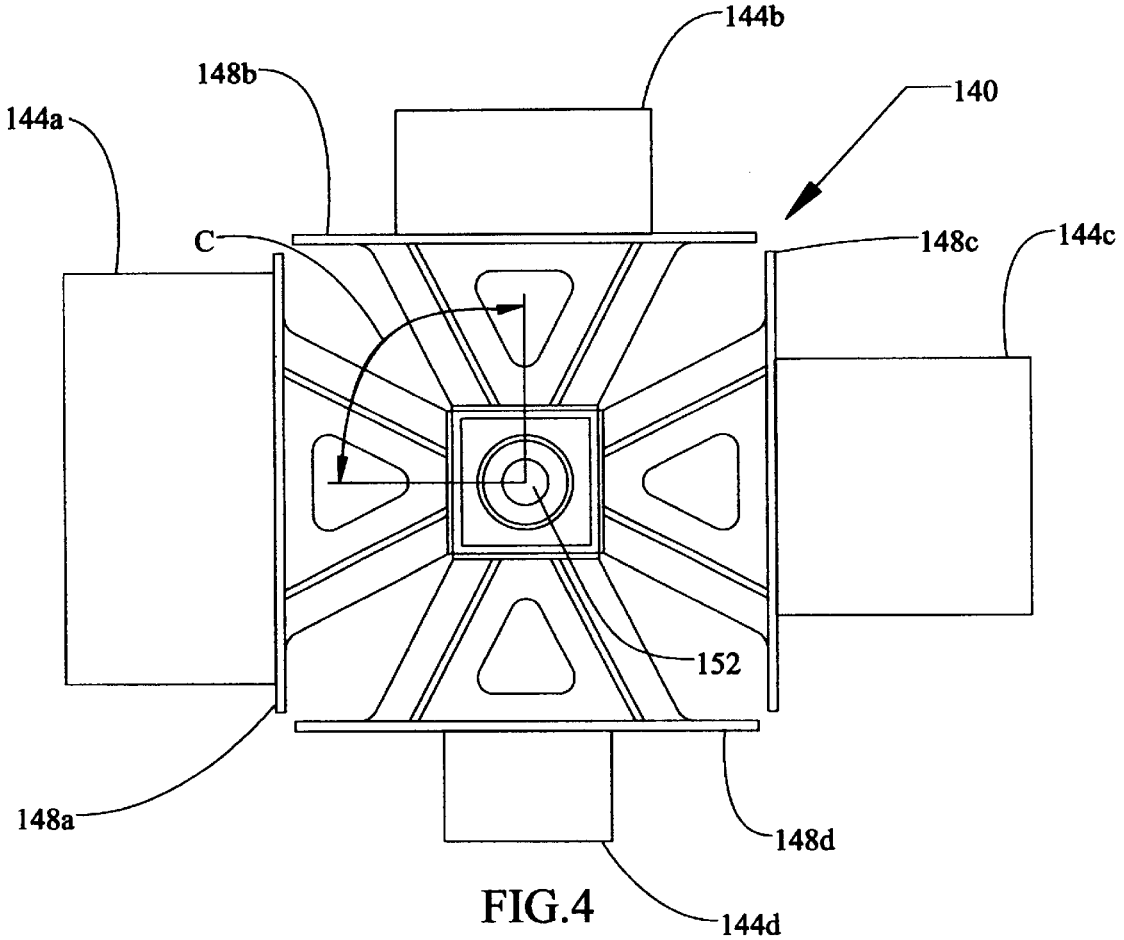
FIG. 4 is a top plan view of a mount used with the accessories module for the casting system shown in FIG. 1.

The accessories module 24 is positioned and provided in the casting system 12 to perform desired operations on the cast article, preferably while the cast article is positioned within the cavities 108*a–d* of the casting module 20. As shown in FIGS. 1–3, the accessories module 24 is positioned generally above the casting module 20. The illustrated accessories module 24 includes a mount 140 and one or more suitable accessories 144*a–d* (shown in FIG. 4). The illustrated mount 140 is a rotary mount adaptable to support four accessories 144*a–d*, although the mount 140 may support any suitable number of accessories. Nonlimiting examples of suitable accessories include a head setter, a ring setter, a strut setter, an unloader, a strainer, or a riser sleeve. The accessory may be any other suitable component. A servomotor 31 provides rotation of accessories in a horizontal plane, for example. Additional servomotors and/or hydraulic actuators are provided for the required positioning and operation of separate accessories.

The illustrated mount 140 includes four mount faces 148*a–d*. The illustrated mount faces 148*a–d* are generally flat surfaces, although they may be formed as desired to accommodate the accessories. The mount faces 148*a–d* are preferably positioned at about 90 degrees with respect to each other, as indicated by the angle "C." The mount faces 148*a–d* may also be positioned and configured for optimal positioning of the accessories 144*a–d*. Likewise, each of the mount faces 148*a–d* may accommodate more than one accessory if desired.

In a preferred embodiment, the mount 140 of the accessories module 24 includes a pivot point 152. The pivot point 152 is positioned approximately in the center of the mount 140. The pivot point 152 is operative to allow the accessories 144*a–d* to be positioned with respect to the casting module 20 under control of the servomechanism.

The pivot point 152 of the mount 140 is useful to allow a series of operations to be performed with respect to one or more portions of the casting module 20. For example, the pivot point 152 may position the strainer accessory generally directly above the casting module 20 to remove impurities from the fill material being provided to the fill inlets 116*a,b* of the casting module 20. Continuing the example, mount 140 rotates about 90° to position the head setter accessory generally directly above the casting module 20 to create a desirable pattern on the cast articles located in the cavities 108*a–d* of the casting module 20. Continuing further the example, mount 140 rotates another 90° to position the strut setter accessory generally directly above the casting module 20 to deposit a strut on the cast articles located in the cavities 108*a–d* of the casting module 20. Concluding the example, mount 140 rotates another 90° to position the unloader accessory generally directly above the casting module 20 to unload the cast articles from casting module 20.

Utility module 28 comprises an electronic control panel 160 and a valve panel 164. Utility module 28 is spaced away from casting module 20 but is connected to it by a plurality of fluid lines and electrical lines.

Control panel 160 includes a programmable controller 41 connected to an interface panel 43 and an output driver 45.

Controller 41 is programmed according to each step of the desired casting process for the articles to be produced, including positioning of the mold sections, pouring of fill material, tilting of the casting module, cooling of the mold, opening of the mold sections, accessory operations, and removal of the finished article, for example. The process can also be controlled manually using push button controls on interface panel 43. Output driver 45 generates command signals and/or direct drive signals for electrical actuators, such as servomotor 31.

Valve panel 164 includes a plurality of electrically controlled valves 35 which are controlled by controller 41 through output driver 45. Some of these are hydraulic valves connected to a source of pressurized hydraulic fluid (e.g., oil or air) to provide a supply of motive power for hydraulic actuators 25, 27, 29, and 60, for example. At least one valve is connected to a source of cooling fluid (e.g., water) for pumping through the casting module to aid in the solidification of the cast article.

By segregating the parts of a casting system into a casting module, accessories module, and utility module as described, it becomes feasible to increase the number of molds that may be placed in a single casting module. Thus, more cast articles can be produced in a smaller area, saving on capital investment. Furthermore, serviceability and packaging of each of the different parts are improved. Design, development, machine fabrication, and operation/maintenance costs are reduced as a result of the simplified structure.

Figure 5:
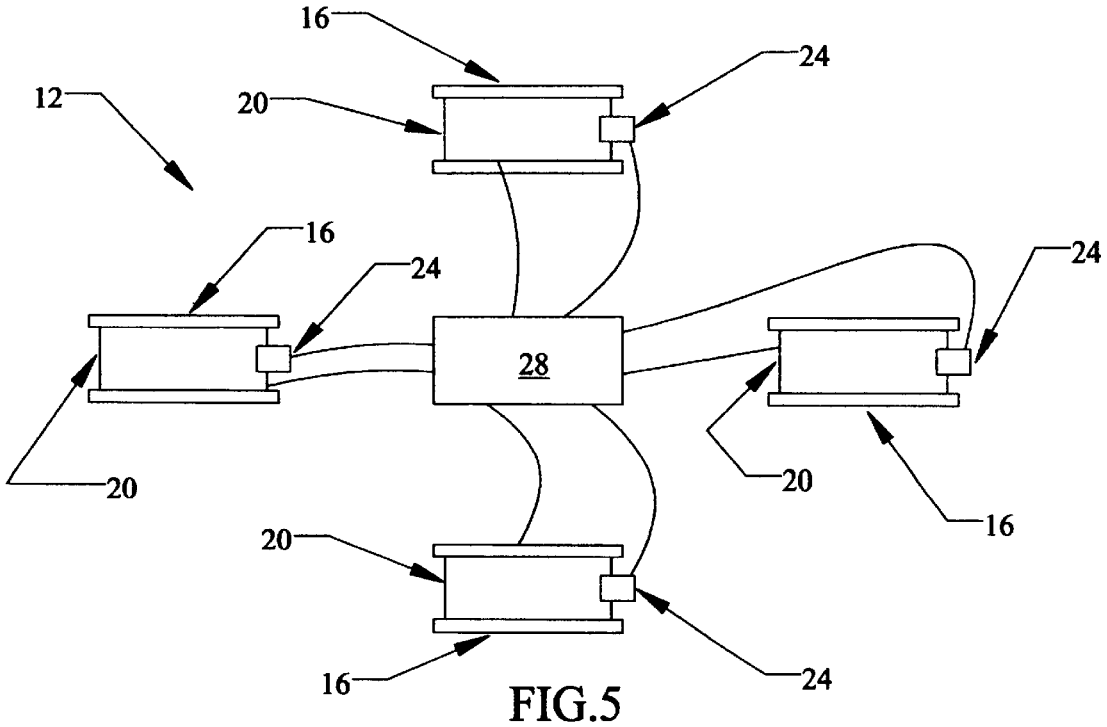
FIG. 5 is a schematic of a cell having four casting modules and a utility module according to the invention.

In a further embodiment shown in FIG. 5, a single utility module 28 is shown operatively connected to four casting modules 20, thereby achieving greater efficiencies and cost savings. Each illustrated casting module 20 is supported by a support structure module 16 and includes an accessories module 24. Shared utility module 28 and the casting modules 20 form a cell. The cell configuration is advantageous for its additional savings in floor space and maximized use of the resources within utility module 28.

The principle and mode of operation of this invention have been described in its preferred embodiments. However, it should be noted that this invention may be practiced otherwise than as specifically illustrated and described without departing from its scope.

What is claimed is:

1. A casting system comprising:

a frame;

a casting module supported on said frame and adapted to receive a plurality of molds for casting articles from a fill material according to a casting process, said casting module including first motive actuators for moving at least portions of said molds during said casting process;

an accessories module supported on said frame and comprising at least one accessory device and second motive actuators for selectably positioning said accessory device in relation to said casting module; and a utility module located remotely from said frame and comprising motive power supplies coupled to said first and second actuators and a programmable controller coupled to said motive power supplies for controlling said casting process.

2. The casting system of claim 1 wherein said motive actuators include hydraulic actuators and wherein said motive power supplies include hydraulic valves adapted to be connected to a source of pressurized hydraulic fluid.

3. The casting system of claim 1 wherein said motive actuators include electric servomechanisms and wherein said motive power supplies include electric drive signals.

4. The casting system of claim 1 wherein said casting module includes cooling channels for receiving a flow of cooling fluid, and wherein said utility module includes coolant valves adapted to be connected to a source of cooling fluid.

5. The casting system of claim 1 further comprising:

a second frame;

a second casting module supported on said second frame and adapted to receive a plurality of second molds for casting articles from a fill material according to a casting process, said second casting module including third motive actuators for moving at least portions of said second molds during said casting process; and a second accessories module supported on said second frame and comprising at least one accessory device and fourth motive actuators for selectably positioning said accessory device in relation to said second casting module;

wherein said second casting module and said second accessories module are coupled to said motive power supplies and said programmable controller of said utility module.

* * * * *